US008593050B2

(12) United States Patent
Chin

(10) Patent No.: US 8,593,050 B2
(45) Date of Patent: Nov. 26, 2013

(54) LAMP SOCKET

(76) Inventor: Kenneth S. Chin, Hayward, CA (US)

( * ) Notice: Subject to any disclaimer, the term of this patent is extended or adjusted under 35 U.S.C. 154(b) by 301 days.

(21) Appl. No.: 13/178,449

(22) Filed: Jul. 7, 2011

(65) Prior Publication Data

US 2012/0286644 A1 Nov. 15, 2012

Related U.S. Application Data

(60) Provisional application No. 61/483,849, filed on May 9, 2011.

(51) Int. Cl.
*H01J 5/48* (2006.01)

(52) U.S. Cl.
USPC ..... 313/318.04; 313/318.03

(58) Field of Classification Search
USPC ..... 313/318.03–318.04
See application file for complete search history.

(56) References Cited

U.S. PATENT DOCUMENTS

| | | | |
|---|---|---|---|
| 5,199,783 | A | 4/1993 | Pelton |
| 5,286,216 | A | 2/1994 | Volz |
| 5,463,540 | A | 10/1995 | Jones |
| 6,099,144 | A | 8/2000 | Klaus |
| 6,113,433 | A | 9/2000 | Al-Turki |
| 7,090,390 | B2 | 8/2006 | Pazula |
| 7,198,500 | B1 | 4/2007 | Lin |
| 7,748,886 | B2 | 7/2010 | Pazula et al. |

*Primary Examiner* — Mary Ellen Bowman
(74) *Attorney, Agent, or Firm* — Patent Law Group LLP; David C. Hsia

(57) ABSTRACT

A lamp socket has the form factor of a standard Edison lamp socket but works with energy efficient light bulbs with a compatible screw base and not with light bulbs with the standard Edison screw base. This allows the lamp socket to be used in the manufacture of conventional light fixtures but qualify as high energy efficient light fixtures under California's Title 24 or similar lighting regulations from other governing bodies.

19 Claims, 14 Drawing Sheets

LAMP SOCKET

CROSS-REFERENCE TO RELATED APPLICATIONS

This application claims the benefit of U.S. Provisional Application No. 61/483,849, filed May 9, 2011, which is incorporated herein by this reference.

FIELD OF INVENTION

This invention relates a lamp socket that has the form factor of a standard Edison lamp socket but works with energy efficient light bulbs with a compatible screw base and not with light bulbs with the standard Edison screw base.

DESCRIPTION OF RELATED ART

The Edison screw fitting is a system of light bulb connectors developed by Thomas Edison. Most have a right-hand threading so that it goes in when turned clockwise and comes out when turned counterclockwise.

SUMMARY

In one or more embodiments of the present disclosure, a lamp socket has the form factor of a standard Edison lamp socket but works with energy efficient light bulbs with a compatible screw base and not with light bulbs with the standard Edison screw base. This allows the lamp socket to be used in the manufacture of conventional light fixtures but qualify as high energy efficient light fixtures under California's Title 24 or similar lighting regulations from other governing bodies.

DETAILED DESCRIPTION OF THE INVENTION

Figure 1:
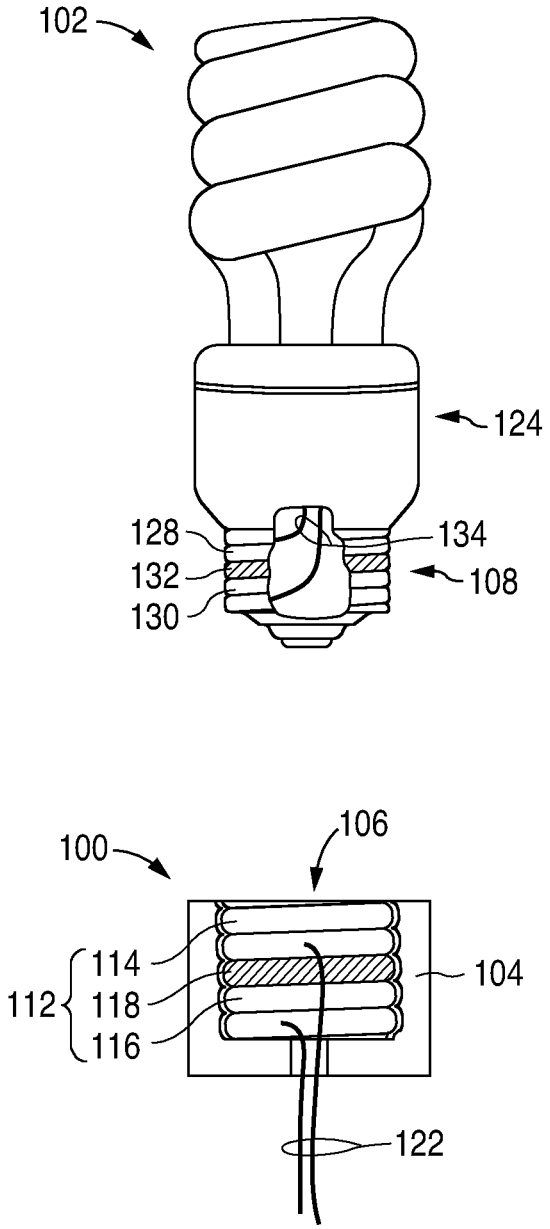
FIG. 1 shows cross-sectional and partial cutout views of a lamp socket and a compatible light bulb with their electrical contacts in a first side-side configuration.

FIG. 1 shows a lamp socket 100 and a compatible light bulb 102 with their electrical contacts in a first side-side configuration in one or more embodiments of the present disclosure. Lamp socket 100, shown in cross-sectional, may have an external form factor similar to a standard Edison lamp socket so it may be used in existing designs of light fixtures. Lamp socket 100 includes a nonconductive housing 104 that defines a cylindrical cavity 106 for receiving a screw base 108 of light bulb 102. In one embodiment, an internally threaded socket sleeve 112 is located in cavity 106 for engaging screw base 108. Socket sleeve 112 includes an upper conductive portion 114 and a lower conductive portion 116 insulated from each other by a non-conductive portion 118. Portions 114 and 116 serve as electrical contacts to screw base 108. Alternatively, cavity 106 is internally threaded for engaging screw base 108, and electrical contacts 114, 116 are conductive tabs located on the internal threads. Electrical contacts 114 and 116 are connected to electrical lines 122 out of lamp socket 100.

Light bulb 102, shown with a partial cutaway, includes a light source 124 and screw base 108 below the light source. Light source 124 meets the high-efficacy standards of California's Title 24 or similar lighting regulations from other governing bodies. Light source 124 may be a light-emitting diode, a fluorescent light source, or another energy efficient light source. Screw base 108 may have the dimensions of a standard Edison screw base. Screw base 108 includes an upper conductive portion 128 and a lower conductive portion 130 insulated from each other by a non-conductive portion 132. Portions 128 and 130 serve as electrical contacts to lamp socket 100. Lead wires 134 from light source 124 are connected to electrical contacts 128 and 130.

Light bulb 102 is screwed into lamp socket 100 in a normal fashion so the corresponding electrical contacts would touch so light bulb 102 can work. When a conventional light bulb with a standard Edison screw base is screwed into lamp socket 100, the electrical contacts would not touch so the conventional light bulb cannot operate. Thus, a light fixture using lamp socket 100 would qualify as a high energy efficient light fixture.

Figure 2A:
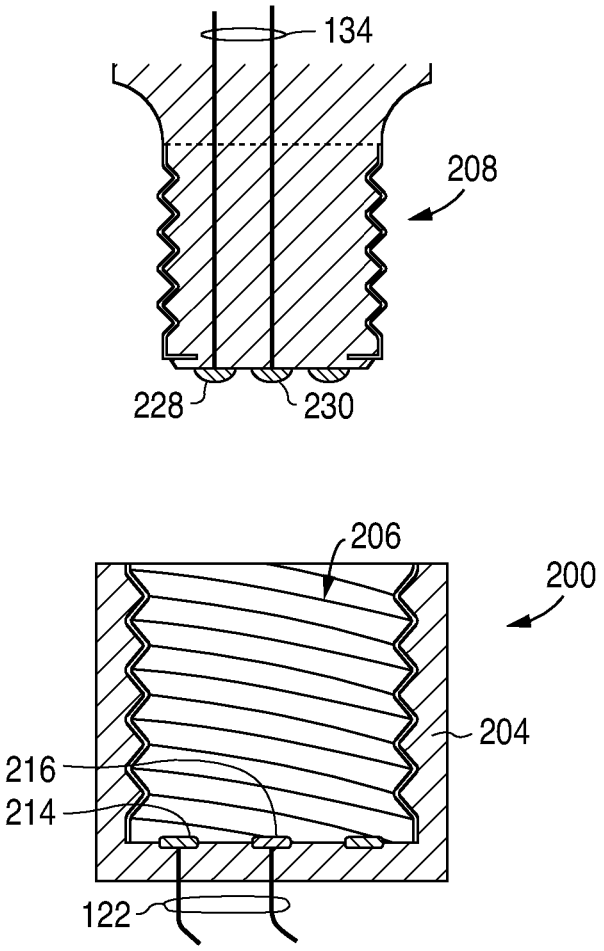
FIG. 2A shows a cross-sectional view of a lamp socket and a compatible screw base with their electrical contacts in a bottom-bottom configuration.
Figure 2B:
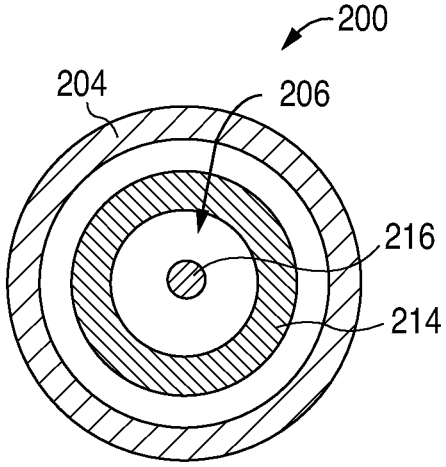
FIG. 2 B shows a top view of the lamp socket of FIG. 2A.

FIG. 2A shows a cross-sectional view of a lamp socket 200 and a compatible screw base 208 with their electrical contacts in a bottom-bottom configuration in one or more embodiments of the present disclosure. Lamp socket 200 may have the general form factor of a standard Edison lamp socket so it may be used in existing designs of light fixtures. Lamp socket 200 includes a nonconductive housing 204 that defines a cylindrical cavity 206 for receiving screw base 208 of a light bulb. Cavity 206 is internally threaded for engaging screw base 208. As FIG. 2B shows in a top view, an outer annular electrical contact 214 and an inner circular electrical contact 216 are located on the floor of cavity 206 of housing 204. Referring back to FIG. 2A, electrical contacts 214 and 216 are connected to electrical lines 122 out of lamp socket 100.

Similar to light bulb 102 (FIG. 1), screw base 208 is part of a light bulb that has an energy efficient light source above the screw base. Screw base 208 may have the dimensions of a standard Edison screw base. The bottom of screw base 208 includes an outer annular electrical contact 228 and an inner circular electrical contact 230. Lead wires 134 from the light source are connected to contacts 228 and 230.

When a conventional light bulb with a standard Edison screw base is screwed into lamp socket 200, the electrical contacts would not touch so the conventional light bulb cannot operate. Thus, a light fixture using lamp socket 200 would qualify as a high energy efficient light fixture.

Figure 3:
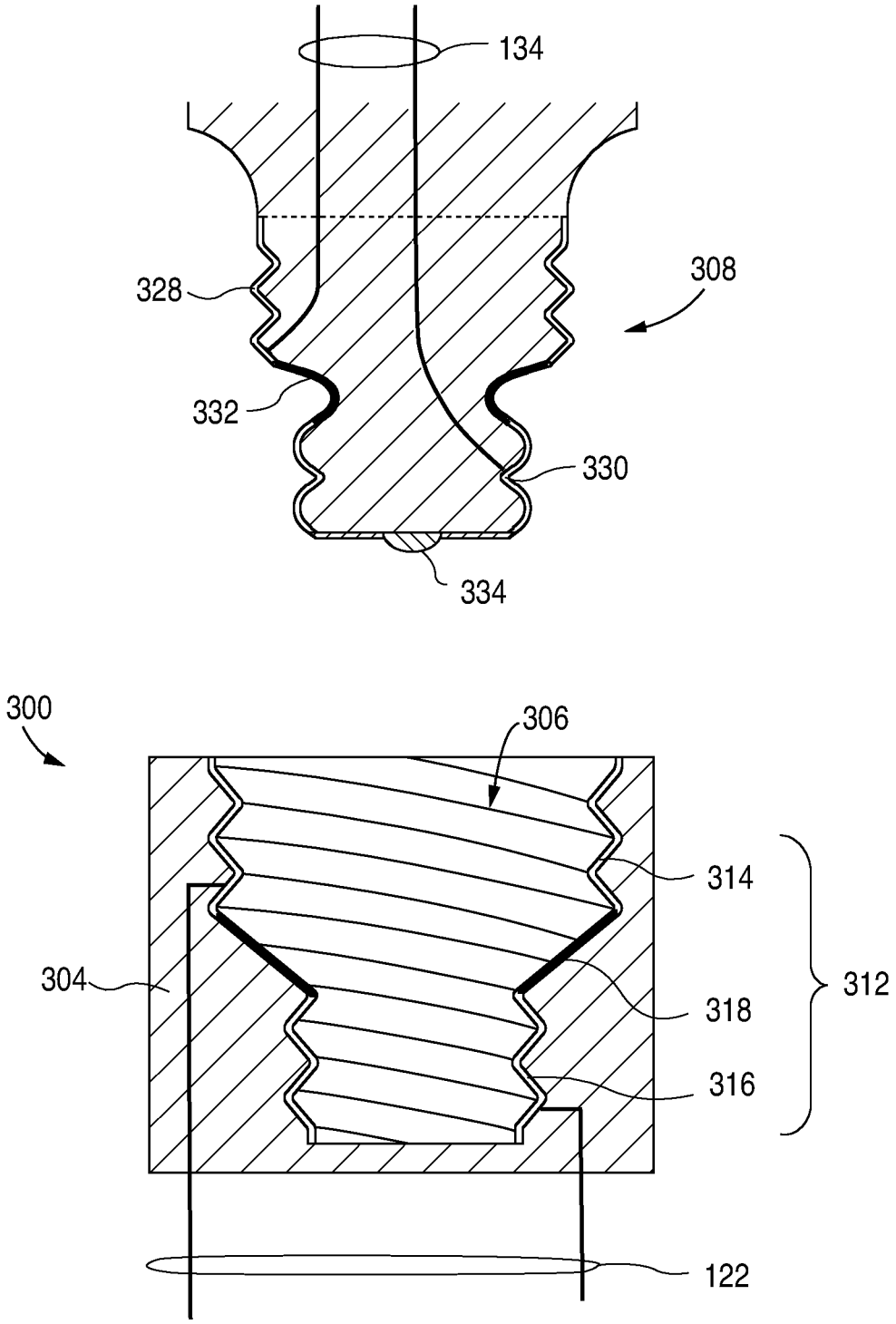
FIG. 3 shows a cross-sectional view of a lamp socket and a compatible screw base with their electrical contacts in a second side-side configuration.

FIG. 3 shows a cross-sectional view of a lamp socket 300 and a compatible screw base 308 with their electrical contacts in a second side-side configuration in one or more embodiments of the present disclosure. Lamp socket 300 may have the general form factor of a standard Edison lamp socket so it may be used in existing designs of light fixtures. Lamp socket 300 includes a nonconductive housing 304 that defines a cavity 306 for receiving screw base 308 of a light bulb. In one embodiment, an internally threaded socket sleeve 312 is located in cavity 306 for engaging screw base 308. Socket sleeve 312 includes an upper conductive portion 314 and a lower conductive portion 316 insulated from each other by a non-conductive portion 318 that narrows from portion 314 to portion 316. Portion 314 has internal threads of a first diameter and portion 316 has internal threads of a second, smaller diameter. Portion 314 may have the diameter and threads of a standard Edison socket. Portions 314 and 316 serve as electrical contacts to screw base 308. Alternatively, cavity 306 is internally threaded with an upper portion of the first diameter and a lower portion with the second diameter, and electrical contacts 314, 316 are conductive tabs located on the upper, lower portions of the internal threads. Electrical contacts 314 and 316 are connected to electrical lines 122 out of lamp socket 300.

Similar to light bulb 102 (FIG. 1), screw base 308 is part of a light bulb that has an energy efficient light source above the screw base. Screw base 308 includes an upper conductive portion 328 of the first diameter and a lower conductive portion contact 330 of the second diameter. Portions 328 and 330 are insulated from each other by a non-conductive portion 332. Portions 328 and 330 serve as electrical contacts to lamp socket 300. Electrical contact 330 may have the diameter and threads of a standard Edison screw base. In one or more embodiments, electrical contact 330 may include the bottom portion 334 of screw base 308 to make the light bulb compatible with the standard Edison lamp socket. Lead wires 134 from the light source are connected to contacts 328 and 330.

When a conventional light bulb with a standard Edison screw base is screwed into lamp socket 300, the electrical contacts would not touch so the conventional light bulb cannot operate. Thus, a light fixture using lamp socket 300 would qualify as a high energy efficient light fixture.

Figure 4:
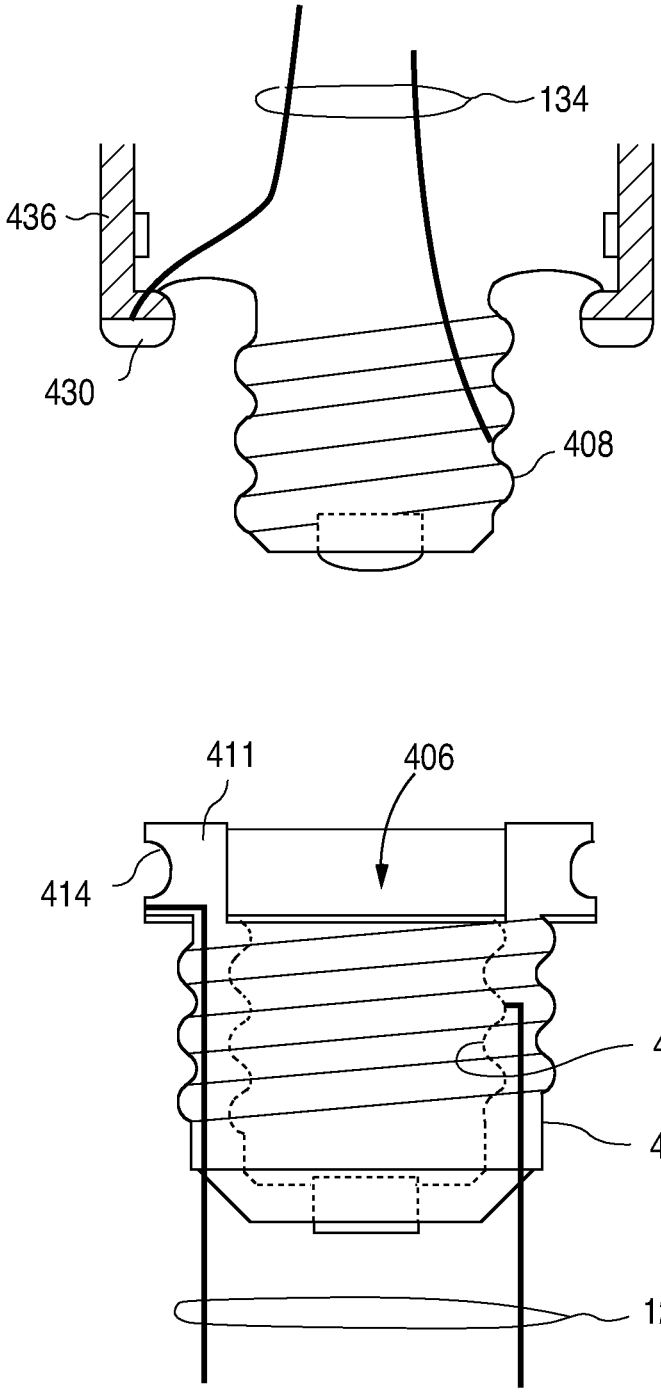
FIG. 4 shows a cross-sectional view of a lamp socket and a compatible screw base with their electrical contacts in a top-side configuration.

FIG. 4 shows a cross-sectional view of a lamp socket 400 and a compatible screw base 408 with their electrical contacts in a top-side configuration in one or more embodiments of the present disclosure. Lamp socket 400 may have the general form factor of a standard Edison lamp socket so it may be used in existing designs of light fixtures. Lamp socket 400 includes a nonconductive housing 404 that defines a cavity 406 for receiving screw base 408 of a light bulb. Lamp socket 400 further includes an annular top 411 above housing 404. Annular top 411 has external threads 414. In one embodiment, annular top 411 is conductive and serves as an electrical contact to screw base 408. Alternatively a conductive tab is located on the external threads of a nonconductive annular top 411 and serves as the electrical contact. In one embodiment, an internally threaded socket sleeve 416 is located in cavity 406 and serves as an electrical contact to screw base 408. Alternatively, cavity 406 is internally threaded for engaging screw base 408, and a conductive tab located on the internal threads of cavity 406 serves as the electrical contact. Electrical contacts 414 and 416 are connected to electrical lines 122 out of lamp socket 400.

Similar to light bulb 102 (FIG. 1), screw base 408 is part of a light bulb that has an energy efficient light source above the screw base. Screw base 408 is conductive and forms an electrical contact to lamp socket 400. Screw base 408 is located below a nonconductive housing 436 for the light source. The lower open end of housing 436 has internal threads for engaging the external threads of annular top 411 of lamp socket 400. An electrical contact 430 is formed on the bottom thread. Lead wires 134 from the light source are connected to electrical contacts 408 and 430.

When a conventional light bulb with a standard Edison screw base is screwed into lamp socket 400, the electrical contacts would not touch so the conventional light bulb cannot operate. Thus, a light fixture using lamp socket 400 would qualify as a high energy efficient light fixture.

Figure 5:
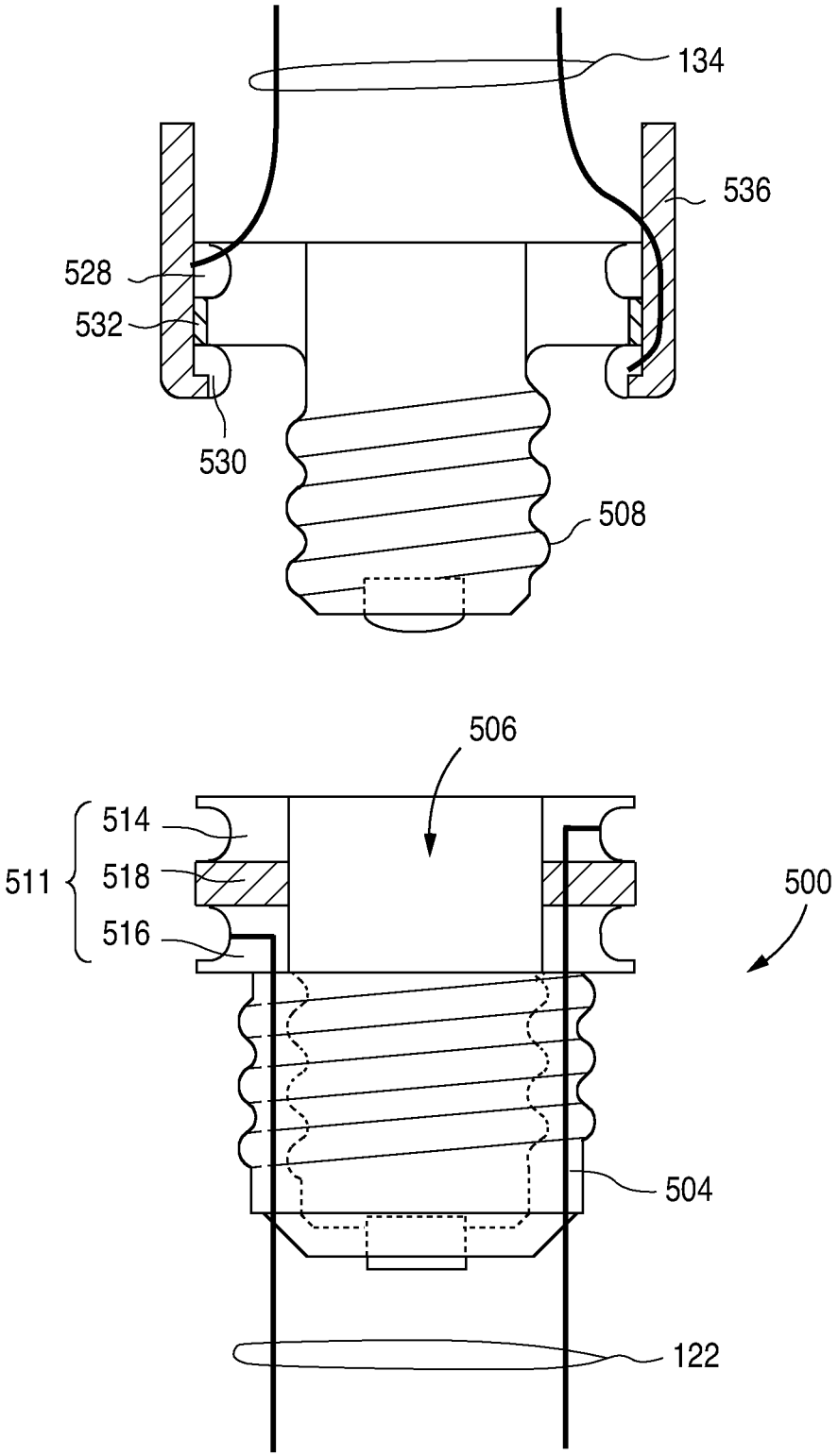
FIG. 5 shows a cross-sectional view of a lamp socket and a compatible screw base with their electrical contacts in a top-top configuration.

FIG. 5 shows a cross-sectional view of a lamp socket 500 and a compatible screw base 508 with their electrical contacts in a top-top configuration in one or more embodiments of the present disclosure. Lamp socket 500 may have the general form factor of a standard Edison lamp socket so it may be used in existing designs of light fixtures. Lamp socket 500 includes a nonconductive housing 504 that defines a cavity 506 for receiving screw base 508 of a light bulb. Lamp socket 500 further includes an annular top 511 above housing 504. Annular top 511 is externally threaded and includes an upper conductive portion 514 and a lower conductive portion 516 insulated from each other by a non-conductive portion 518. Portions 514 and 516 serve as electrical contacts to screw base 508. Alternatively conductive tabs are located on the external threads of a nonconductive annular top 511 and serve as the electrical contacts. Electrical contacts 514 and 516 are connected to electrical lines 122 out of lamp socket 500.

Similar to light bulb 102 (FIG. 1), screw base 508 is part of a light bulb that has an energy efficient light source above the screw base. Screw base 508 is conductive and forms an electrical contact to lamp socket 500. Screw base 508 is located below a nonconductive housing 536 for the light source. The lower open end of housing 536 is internally threaded and includes an upper conductive portion 528 and a lower conductive portion 530 insulated from each other by a nonconductive portion 532. Portions 528 and 530 serve as electrical contacts to lamp socket 500. Alternatively conductive tabs are located on the internal threads of housing 536 and serve as the electrical contacts. Lead wires 134 from the light source are connected to electrical contacts 528 and 530.

When a conventional light bulb with a standard Edison screw base is screwed into lamp socket 500, the electrical contacts would not touch so the conventional light bulb cannot operate. Thus, a light fixture using lamp socket 500 would qualify as a high energy efficient light fixture.

Figure 6:
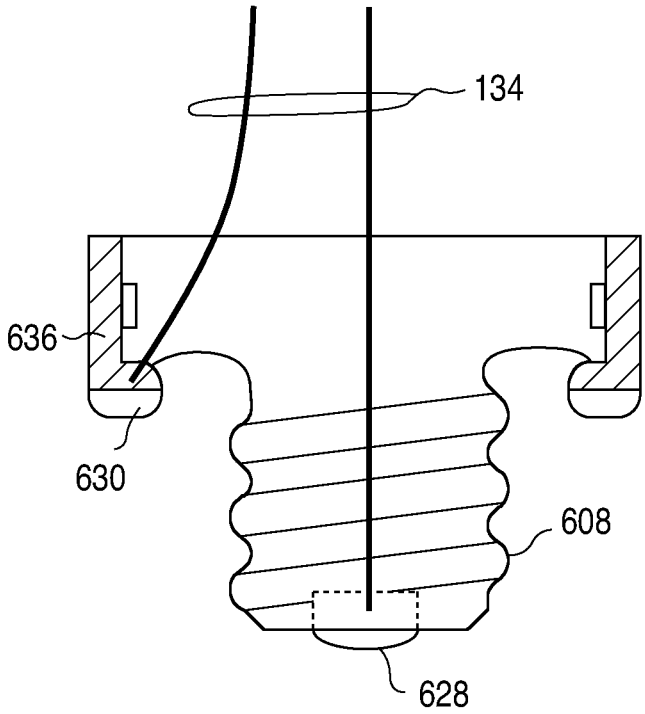
FIG. 6 shows a cross-sectional view of a lamp socket and a compatible screw base with their electrical contacts in a top-bottom configuration.
Figure 6:
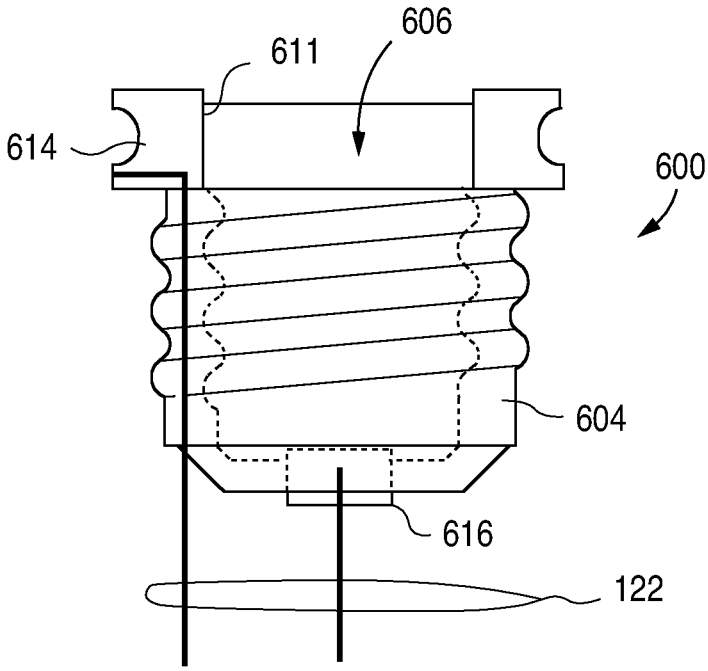

FIG. 6 shows a cross-sectional view of a lamp socket 600 and a compatible screw base 608 with their electrical contacts in a top-bottom configuration in one or more embodiments of the present disclosure. Lamp socket 600 may have the general form factor of a standard Edison lamp socket so it may be used in existing designs of light fixtures. Lamp socket 600 includes a nonconductive housing 604 that defines a cavity 606 for receiving screw base 608 of a light bulb. Lamp socket 600 further includes an annular top 611 above housing 604. Annular top 611 has external threads 614. In one embodiment, annular top 611 is conductive and serves as an electrical contact to screw base 608. Alternatively, a conductive tab is located on the external threads of a nonconductive annular top 611 and serves as the electrical contact. Cavity 606 is internally threaded for engaging screw base 608, and an electrical contact 616 is located on the floor of cavity 606. Electrical contacts 614 and 616 are connected to electrical lines 122 out of lamp socket 600.

Similar to light bulb 102 (FIG. 1), screw base 608 is part of a light bulb that has an energy efficient light source above the screw base. The bottom 628 of screw base 608 is conductive and forms an electrical contact to lamp socket 600. Screw base 608 is located below a nonconductive housing 636 for the light source. The lower open end of housing 636 has internal threads for engaging the external threads of annular top 611 of lamp socket 600. An electrical contact 630 is formed on the bottom thread. Lead wires 134 from the light source are connected to electrical contacts 628 and 630.

When a conventional light bulb with a standard Edison screw base is screwed into lamp socket 600, the electrical contacts would not touch so the conventional light bulb cannot operate. Thus, a light fixture using lamp socket 600 would qualify as a high energy efficient light fixture.

Figure 7:
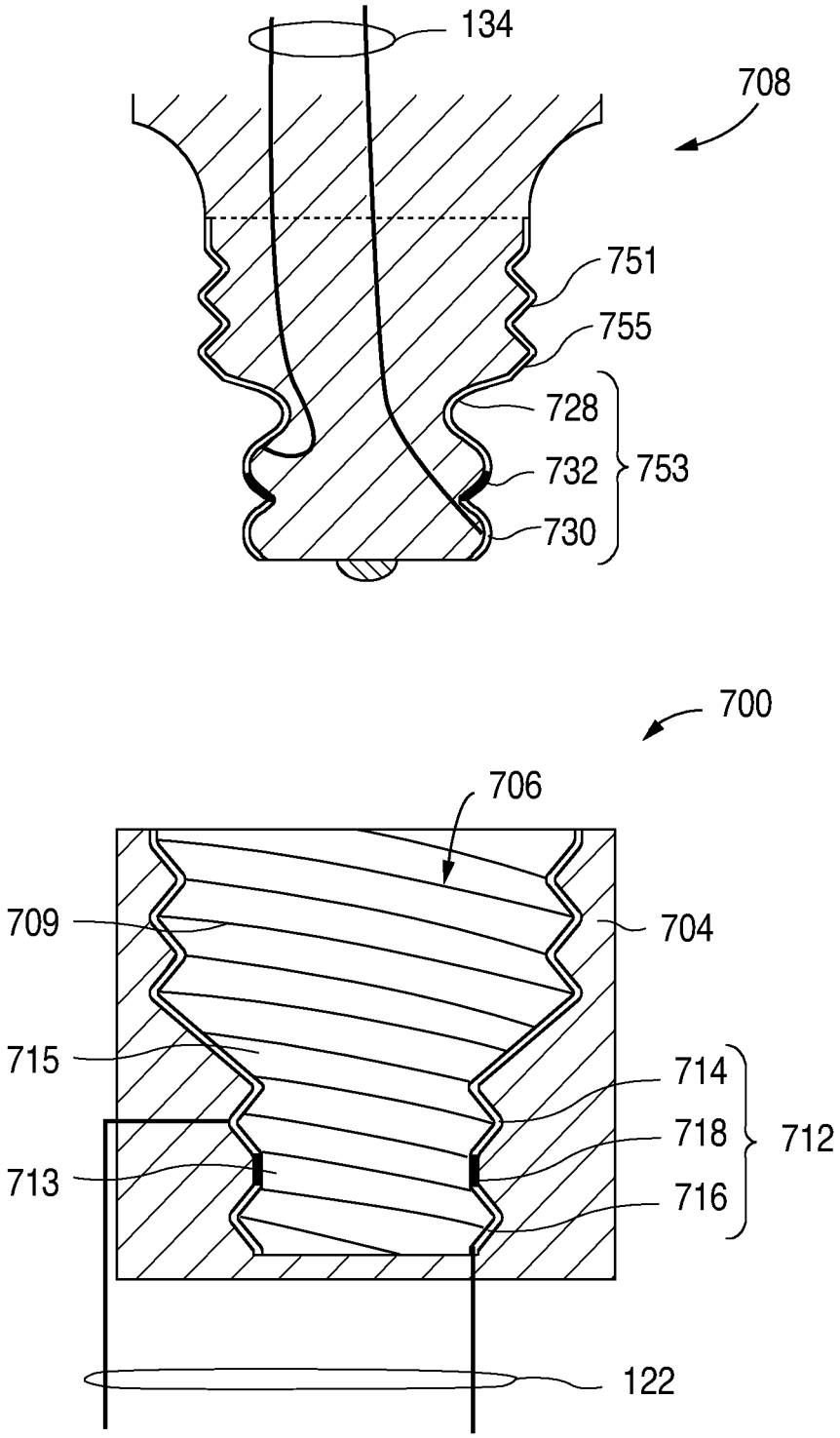
FIG. 7 shows a cross-sectional view of a lamp socket and a compatible screw base with their electrical contacts in a third side-side configuration.

FIG. 7 shows a cross-sectional view of a lamp socket 700 and a compatible screw base 708 with their electrical contacts in a third side-side configuration in one or more embodiments of the present disclosure. Lamp socket 700 may have the general form factor of a standard Edison lamp socket so it may be used in existing designs of light fixtures. Lamp socket 700 includes a nonconductive housing 704 that defines a cavity 706 for receiving screw base 708 of a light bulb. Cavity 706 includes an upper portion 709 of a first diameter, a lower portion 713 of a second, smaller diameter, and a neck portion 715 joining portions 709 and 713. Portion 709 may have the diameter and threads of a standard Edison socket. In one embodiment, an internally threaded socket sleeve 712 is located in lower portion 713. Socket sleeve 712 includes an upper conductive portion 714 and a lower conductive portion 716 insulated from each other by a non-conductive portion 718. Portions 714 and 716 serve as electrical contacts to screw base 708. Alternatively, electrical contacts 714 and 716 are conductive tabs located on the internal threads. Electrical contacts 714 and 716 are connected to electrical lines 122 out of lamp socket 700.

Similar to light bulb 102 (FIG. 1), screw base 708 is part of a light bulb that has an energy efficient light source above the screw base. Screw base 708 includes of an upper portion 751 of the first diameter, a lower narrow portion 753 of the second diameter, and a narrowing neck portion 755 joining portions 751 and 753. Upper portion 751 may have the diameter and threads of a standard Edison screw base. Lower portion 753 includes an upper conductive portion 728 and a lower conductive portion 730. Portions 728 and 730 are insulated from each other by a non-conductive portion 732. Portions 728 and 730 serve as electrical contacts to lamp socket 700. Lead wires 134 from the light source are connected to contacts 728 and 730.

When a conventional light bulb with a standard Edison screw base is screwed into lamp socket 700, the electrical contacts would not touch so the conventional light bulb cannot operate. Thus, a light fixture using lamp socket 700 would qualify as a high energy efficient light fixture.

Figure 8:
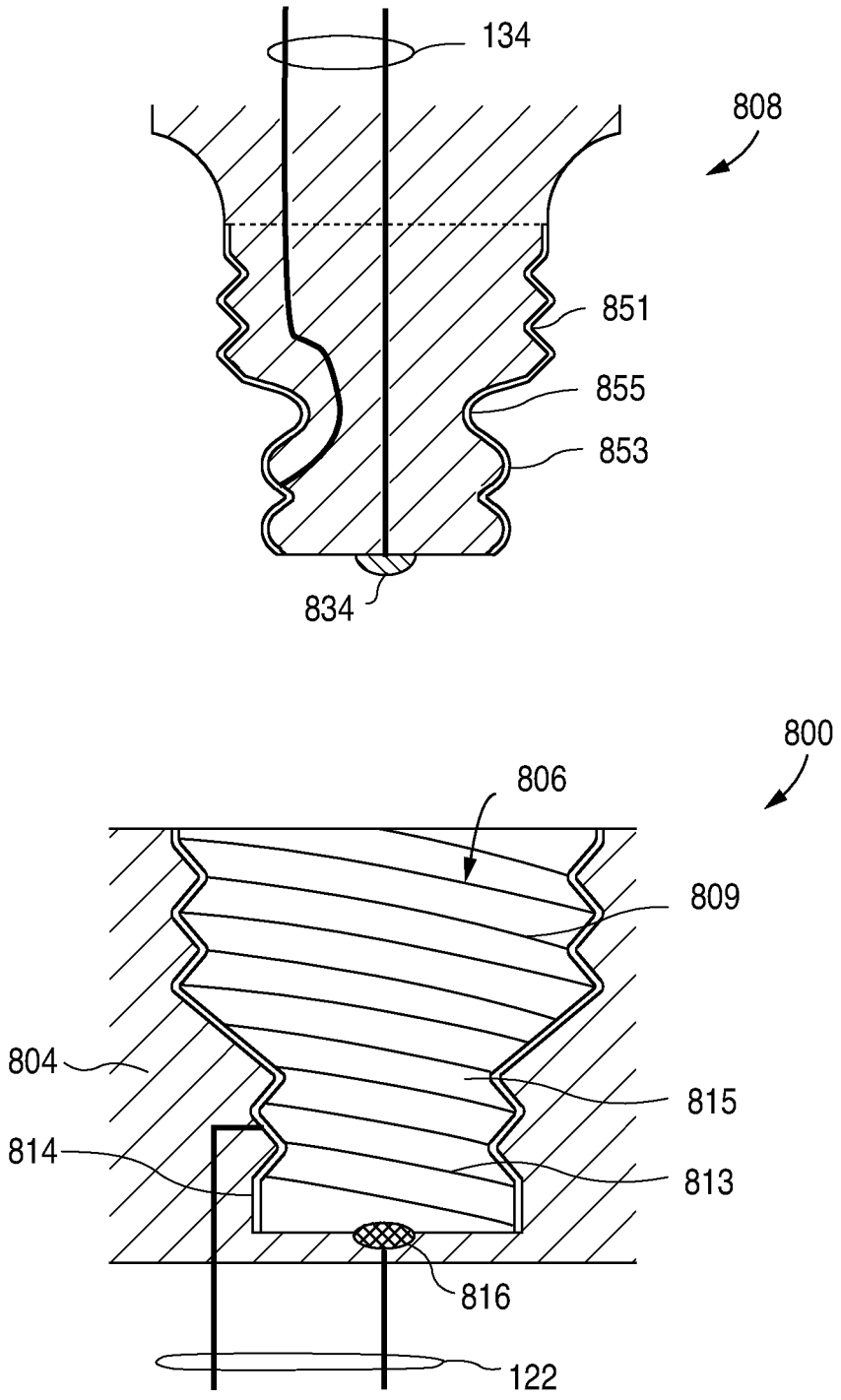
FIG. 8 shows a cross-sectional view of a lamp socket and a compatible screw base with their electrical contacts in a first side-bottom configuration.

FIG. 8 shows a cross-sectional view of a lamp socket 800 and a compatible screw base 808 with their electrical contacts in a first side-bottom configuration in one or more embodiments of the present disclosure. Lamp socket 800 may have the general form factor of a standard Edison lamp socket so it may be used in existing designs of light fixtures. Lamp socket 800 includes a nonconductive housing 804 that defines a cavity 806 for receiving screw base 808 of a light bulb. Cavity 806 includes an upper portion 809 of a first diameter, a lower portion 813 of a second, smaller diameter, and a neck portion 815 joining portions 809 and 813. Portion 809 may have the diameter and threads of a standard Edison socket. In one embodiment, an internally threaded socket sleeve 814 is located in lower portion 813. Socket sleeve 814 serves as an electrical contact to screw base 808. Alternatively, electrical contact 814 is a conductive tab located on the internal threads. An electrical contact 816 is located on the bottom of cavity 806. Electrical contacts 814 and 816 are connected to electrical lines 122 out of lamp socket 800.

Similar to light bulb 102 (FIG. 1), screw base 808 is part of a light bulb that has an energy efficient light source above the screw base. Screw base 808 includes an upper portion 851 of the first diameter, a lower narrow portion 853 of the second diameter, and a narrowing neck portion 855 joining portions 851 and 853. Portion 851 may have the diameter and threads of a standard Edison screw base. Portion 853 serves as an electrical contact to lamp socket 800. An electrical contact 834 is located at the bottom of screw base 808. Electrical contact 834 is insulated from portion 853 by the surrounding material. Lead wires 134 from the light source are connected to electrical contacts 834 and 853.

When a conventional light bulb with a standard Edison screw base is screwed into lamp socket 800, the electrical contacts would not touch so the conventional light bulb cannot operate. Thus, a light fixture using lamp socket 800 would qualify as a high energy efficient light fixture.

Figure 9:
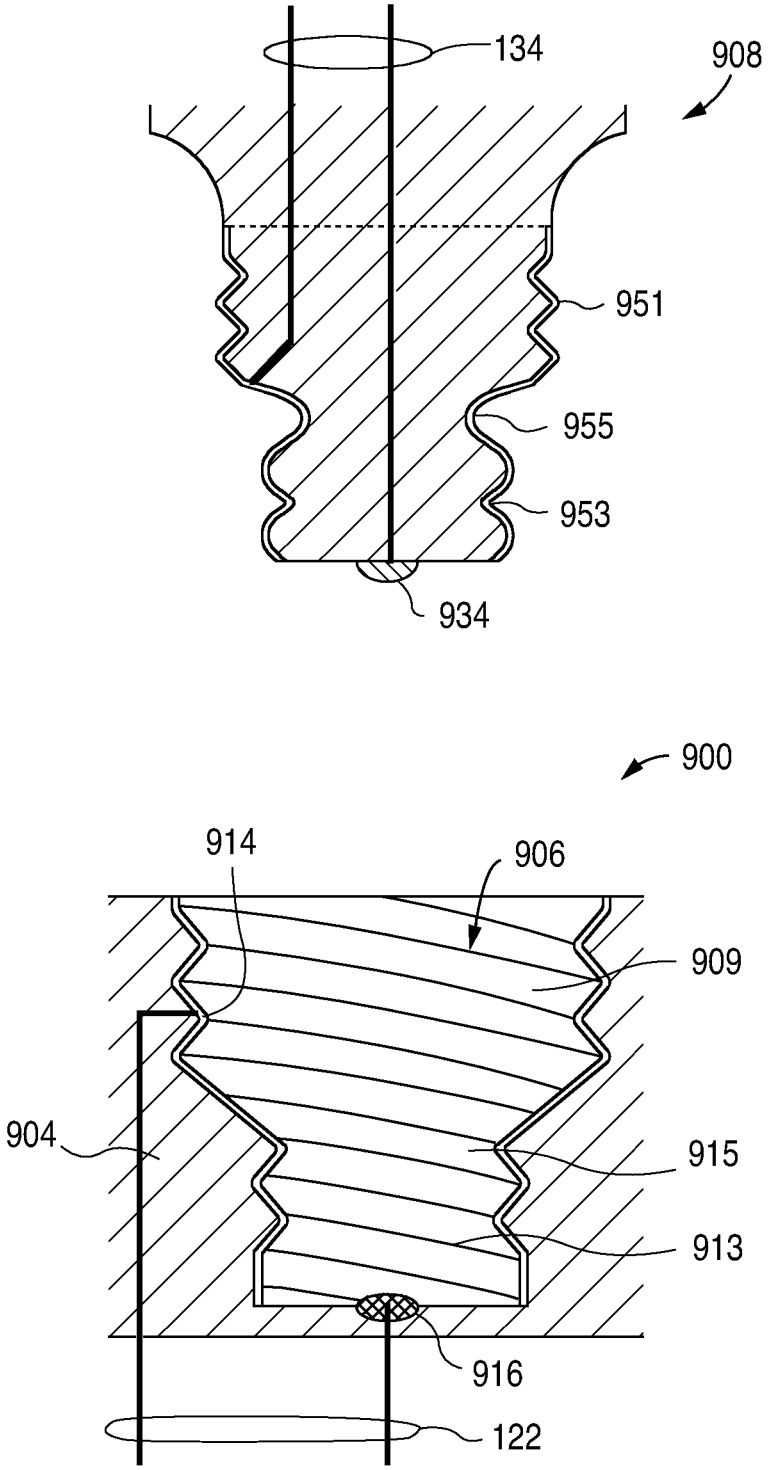
FIG. 9 shows a cross-sectional view of a lamp socket and a compatible screw base with their electrical contacts in a second side-bottom configuration.

FIG. 9 shows a cross-sectional view of a lamp socket 900 and a compatible screw base 908 with their electrical contacts in a second side-bottom configuration in one or more embodiments of the present disclosure. Lamp socket 900 may have the general form factor of a standard Edison lamp socket so it may be used in existing designs of light fixtures. Lamp socket 900 includes a nonconductive housing 904 that defines a cavity 906 for receiving screw base 908 of a light bulb. Cavity 906 includes an upper portion 909 of a first diameter, a lower portion 913 of a second, smaller diameter, and a neck portion 915 joining portions 909 and 913. Portion 909 may have the diameter and threads of a standard Edison socket. In one embodiment, an internally threaded socket sleeve 914 is located in upper portion 909. Socket sleeve 914 serves as an electrical contact to screw base 908. Alternatively, electrical contact 914 is a conductive tab located on the internal threads. An electrical contact 916 is located on the bottom of cavity 906. Electrical contacts 914 and 916 are connected to electrical lines 122 out of lamp socket 900.

Similar to light bulb 102 (FIG. 1), screw base 908 is part of a light bulb that has an energy efficient light source above the screw base. Screw base 908 includes an upper portion 951 of the first diameter, a lower narrow portion 953 of the second diameter, and a narrowing neck portion 955 joining portions 951 and 953. Portion 951 may have the diameter and threads of a standard Edison screw base. Portion 951 serves as an electrical contact to lamp socket 900. An electrical contact 934 is located at the bottom of screw base 908. Electrical contact 934 is insulated from portion 951 by the surrounding material. Lead wires 134 from the light source are connected to electrical contacts 934 and 951.

When a conventional light bulb with a standard Edison screw base is screwed into lamp socket 900, the electrical contacts would not touch so the conventional light bulb cannot operate. Thus, a light fixture using lamp socket 900 would qualify as a high energy efficient light fixture.

Figure 10:
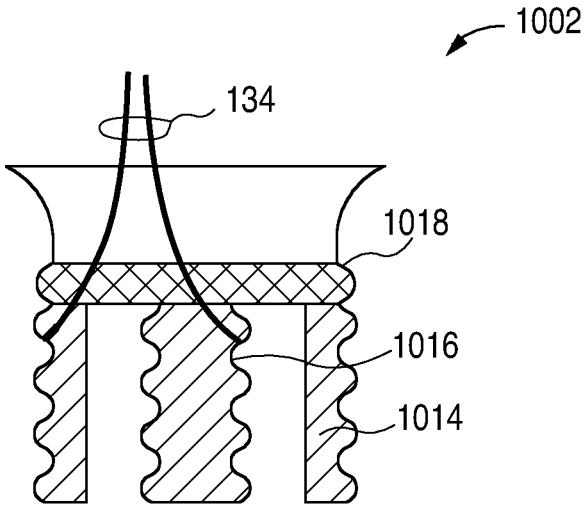
FIG. 10 shows a cross-sectional view of a lamp double socket 1000 and a compatible double screw base 1002 with their electrical contacts in an inner-outer configuration.
Figure 10:
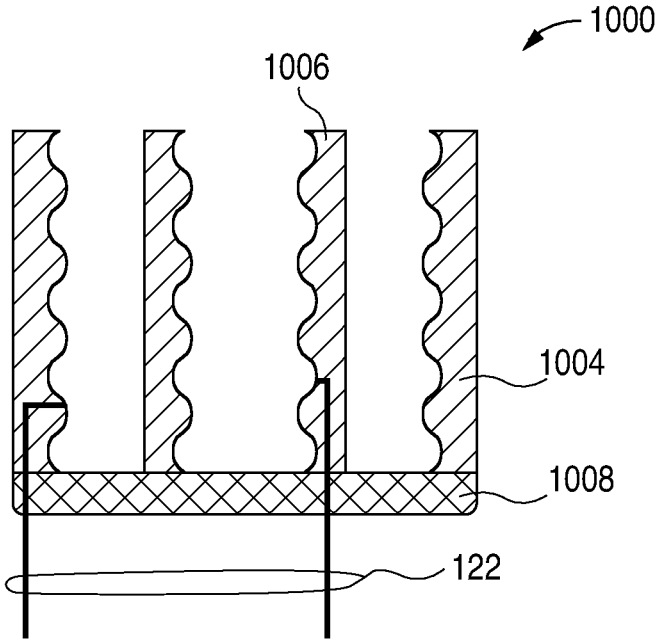

FIG. 10 shows a cross-sectional view of a lamp assembly having a lamp double socket 1000 and a compatible double screw base 1002 with their electrical contacts in an inner-outer configuration in one or more embodiments of the present disclosure. Double socket 1000 may have the general form factor of a standard Edison lamp socket so it may be used in existing designs of light fixtures. Double socket 1000 includes an outer socket 1004 and an inner socket 1006 located within the outer socket. Sockets 1004 and 1006 are concentrically seated on a socket base 1008. Sockets 1004 and 1006 are generally cylindrical and have conductive internal threads that serve as first and second electrical contacts to double screw base 1002.

Each socket may be entirely conductive or consist of a conductive screw shell within a nonconductive shell. Alternatively sockets 1004 and 1006 have nonconductive internal threads and conductive tabs on the internal threads that serve as the first and the second electrical contacts. Socket base 1008 may be entirely nonconductive or consist of a nonconductive body with electrical connections from sockets 1004 and 1006 to terminal screws. The first and the second electrical contacts are connected directly or coupled indirectly to electrical lines 122 out of double socket 1000. For example, electrical lines 122 pass through socket base 1008 and sockets 1004, 1006 to make direct contact with the conductive internal threads. Alternatively, electrical lines 122 are connected to the terminal screws of a socket base 1008 electrically connected to sockets 1004 and 1006.

Socket 1004 has a first diameter and socket 1006 has a second, smaller diameter. Socket 1004 may have the diameter and threads of a larger standard Edison socket, such as a medium or standard E26 socket. Socket 1006 may have the diameter and threads of a smaller standard Edison socket, such as a candelabra E12 socket.

Similar to light bulb 102 (FIG. 1), double screw base 1002 is part of a light bulb that has an energy efficient light source above the screw base. Double screw base 1002 includes an outer screw base 1014 with an open end and an inner screw base 1016 located within the outer screw base. Screw bases 1014 and 1016 are concentrically seated on a base 1018. Screw bases 1014 and 1016 are generally cylindrical and have conductive external threads that match the internal threads of sockets 1004 and 1006. The external threads serve as third and fourth electrical contacts to double socket 1000.

Each screw base may be entirely conductive or consist of a conductive screw sleeve around a nonconductive shell. Alternatively screw bases 1014 and 1016 have nonconductive external threads and conductive tabs on the external threads that serve as the third and the fourth electrical contacts. Lead wires 134 from the light source are connected directly or coupled indirectly to the third and the fourth electrical contacts. For example, lead wires 134 pass through base 1018 and screw bases 1014, 1016 to make direct contact with the conductive external threads.

Screw base 1014 has a first diameter and screw base 1016 has a second, smaller diameter. Screw base 1014 may have the diameter and threads of a larger standard Edison screw base, such as a medium or standard E26 screw base. Screw base 1016 may have the diameter and threads of a smaller standard Edison screw base, such as a candelabra E12 screw base.

A light bulb with double screw base 1002 is screwed into double socket 1000 in a normal fashion so the first and the third electrical contacts would touch, and the second and the fourth electrical contacts would touch. As a conventional light bulb with a standard Edison screw base cannot be screwed into double socket 1000, a light fixture using the double socket would qualify as a high energy efficient light fixture.

Figure 11:
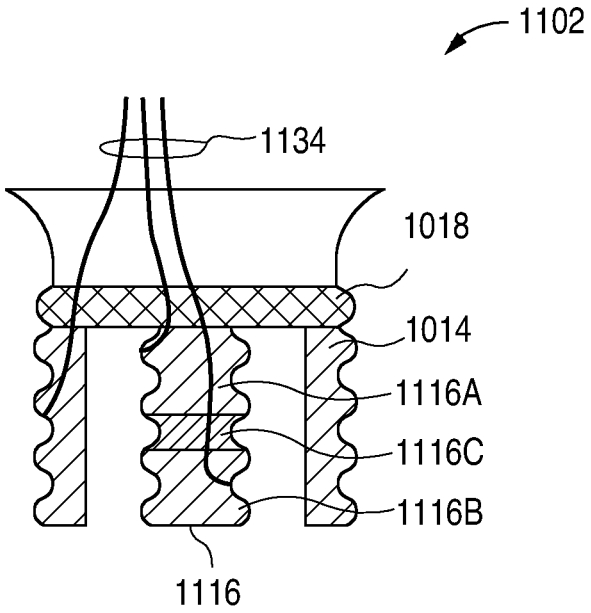
FIG. 11 shows a cross-sectional view of a lamp double socket and a compatible double screw base with their electrical contacts in a double inner-single outer configuration.
Figure 11:
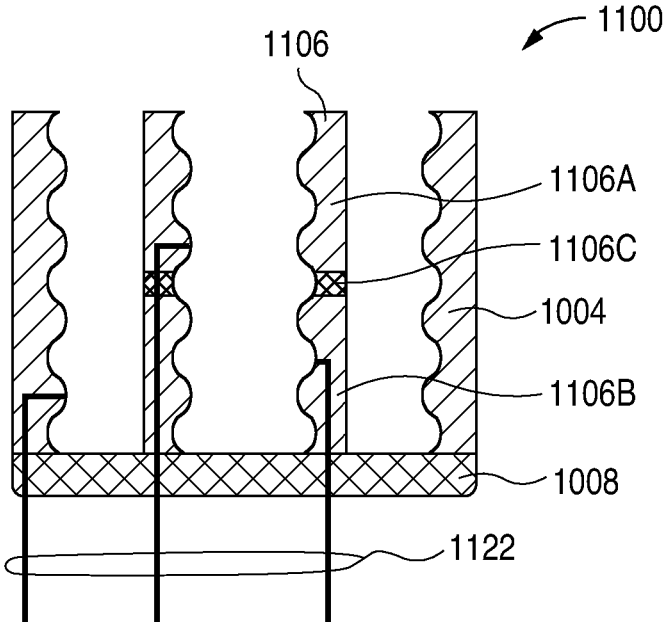

FIG. 11 shows a cross-sectional view of a lamp assembly having a lamp double socket 1100 and a compatible double screw base 1102 with their electrical contacts in a double inner-single outer configuration in one or more embodiments of the present disclosure. Double socket 1100 is similar to double socket 1000 (FIG. 10) except inner socket 1006 (FIG. 10) has been replaced by an inner socket 1106. Socket 1106 has similar dimensions as socket 1006. Socket 1106 includes internal threads with a conductive upper portion 1106A and a conductive lower portion 1106B insulated from each other by a non-conductive middle portion 1106C. The conductive internal threads of socket 1004, conductive internal thread portion 1106A, and conductive internal thread portion 1106B serve as first, second, and third electrical contacts to double screw base 1102. The three electrical contacts are connected directly or coupled indirectly to electrical lines 1122 out of double socket 1100. The three electrical contacts allows double socket 1100 to be used with three-way bulbs or with relays for three-way switching. Depending on the application, less than all the contacts may be utilized.

Double screw base 1102 is similar to double screw base 1002 (FIG. 10) except inner screw base 1016 (FIG. 10) has been replaced by an inner screw base 1116. Screw base 1116 has similar dimensions as screw base 1016. Screw base 1116 includes external threads with a conductive upper portion 1116A and a conductive lower portion 1116B insulated from each other by a non-conductive middle portion 1116C. The conductive external threads of screw base 1014, conductive external thread portion 1116A, and conductive external thread portion 1116B serve as fourth, fifth, and sixth electrical contacts to double socket 1102. Lead wires 1134 from the light source are connected directly or coupled indirectly to the three electrical contacts. Lead wires 1134 are connected to the light source according to the purpose of the application, such as providing a three-way bulb or three-way switching. Depending on the application, less than all the contacts may be utilized.

A light bulb with double screw base 1102 is screwed into double socket 1100 in a normal fashion so the first and the fourth electrical contacts would touch, the second and the fifth electrical contacts would touch, and the third and the sixth electrical contacts would touch. As a conventional light bulb with a standard Edison screw base cannot be screwed into double socket 1100, a light fixture using the double socket would qualify as a high energy efficient light fixture.

Figure 12:
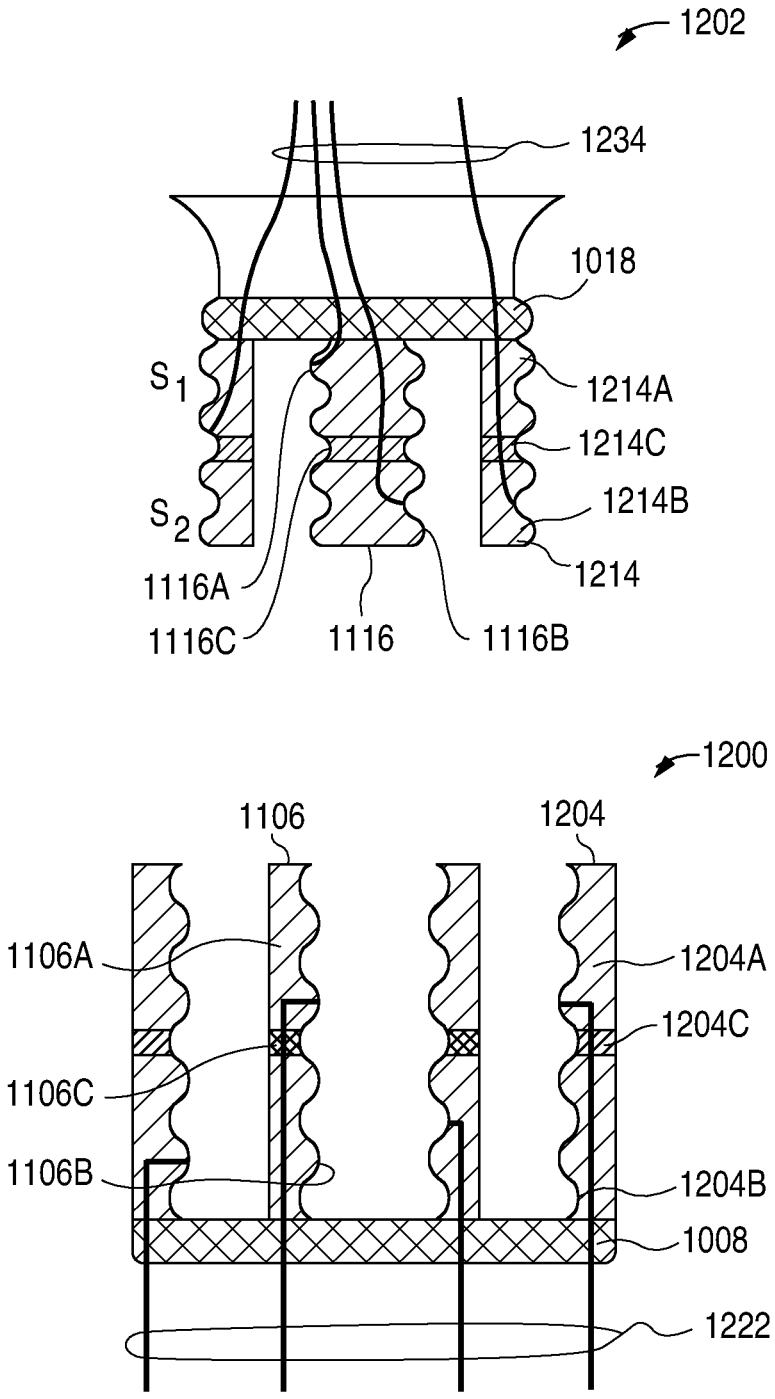
FIG. 12 shows a cross-sectional view of a lamp double socket and a compatible double screw base with their electrical contacts in a double inner-double outer configuration.

FIG. 12 shows a cross-sectional view of a lamp assembly with a lamp double socket 1200 and a compatible double screw base 1202 with their electrical contacts in a double inner-double outer configuration in one or more embodiments of the present disclosure. Double socket 1200 is similar to double socket 1100 (FIG. 11) except outer socket 1004 (FIG. 11) has been replaced by an outer socket 1204. Socket 1204 has similar dimensions as socket 1004. Socket 1204 includes internal threads with a conductive upper portion 1204A and a conductive lower portion 1204B insulated from each other by a non-conductive middle portion 1204C. Conductive internal thread portions 1204A, 1204B, 1106A, and

1106B serve as first, third, second, and fourth electrical contacts to double screw base 1202. The four electrical contacts are connected directly or coupled indirectly to electrical lines 1222 out of double socket 1200. The four electrical contacts allows double socket 1200 to be used with multi-way bulbs or with relays for multi-way switching. Depending on the application, less than all the contacts may be utilized.

Double screw base 1202 is similar to double screw base 1102 (FIG. 11) except outer screw base 1014 (FIG. 11) has been replaced by an outer screw base 1214. Screw base 1214 has similar dimensions as screw base 1014. Screw base 1214 includes an open end and external threads with a conductive upper portion 1214A and a conductive lower portion 1214B insulated from each other by a non-conductive middle portion 1214C. Conductive external thread portions 1214A, 1214B, 1116A, and 1116B serve as fifth, sixth, seventh, and eighth electrical contacts to double socket 1200. Lead wires 1234 from the light source are connected directly or coupled indirectly to the four electrical contacts. Lead wires 1234 are connected to the light source according to the purpose of the application, such as providing a multi-way bulb or multi-way switching. Depending on the application, less than all the contacts may be utilized.

A light bulb with double screw base 1202 is screwed into double socket 1200 in a normal fashion so the first and the fifth electrical contacts would touch, the third and the sixth electrical contacts would touch, the second and the seventh electrical contacts would touch, and the fourth and the eighth electrical contacts would touch. As a conventional light bulb with a standard Edison screw base cannot be screwed into double socket 1200, a light fixture using the double socket would qualify as a high energy efficient light fixture.

Figure 13:
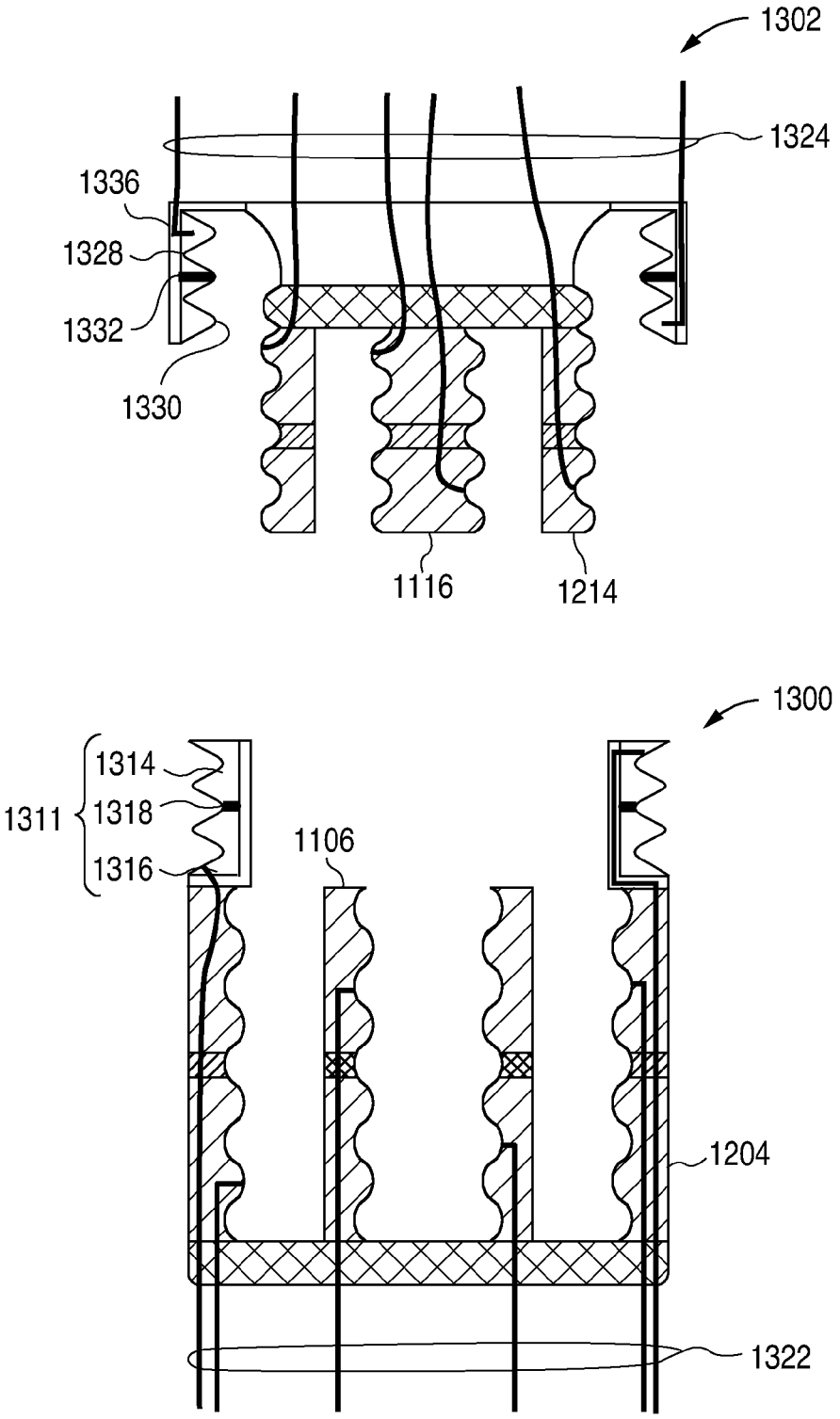
FIG. 13 shows a cross-sectional view of a lamp triple socket and a compatible triple screw base with their electrical contacts in a top-side configuration.

FIG. 13 shows a cross-sectional view of a lamp triple socket 1300 and a compatible triple screw base 1302 with their electrical contacts in a top-side configuration in one or more embodiments of the present disclosure. Triple socket 1300 is similar to double socket 1200 (FIG. 12) with top external threads 1311 added to outer socket 1204. External threads 1311 includes an upper conductive portion 1314 and a lower conductive portion 1316 insulated from each other by a non-conductive portion 1318. Conductive threaded portions 1204A (FIG. 12), 1204B (FIG. 12), 1106A (FIG. 12), 1106B (FIG. 12), 1314, and 1316, serve as first, third, second, fourth, ninth, and tenth electrical contacts to triple screw base 1302. The six electrical contacts are connected directly or coupled indirectly to electrical lines 1322 out of triple socket 1300. The six electrical contacts allows double socket 1100 to be used with multi-way bulbs or with relays for multi-way switching. Depending on the application, less than all the contacts may be utilized.

Triple screw base 1302 is similar to double screw base 1202 (FIG. 12) with an additional housing 1336. The lower open end of housing 1336 is internally threaded and includes a conductive upper portion 1328 and a conductive lower portion 1330 insulated from each other by a non-conductive middle portion 1332. Conductive threaded portions 1214A (FIG. 12), 1214B (FIG. 12), 1116A (FIG. 12), 1116B (FIG. 12), 1328, and 1330 serve as fifth, sixth, seventh, eighth, eleventh, and twelfth electrical contacts to triple socket 1300. Lead wires 1324 from the light source are connected directly or coupled indirectly to the six electrical contacts. Lead wires 1324 are connected to the light source according to the purpose of the application, such as providing a multi-way bulb or multi-way switching. Depending on the application, less than all the contacts may be utilized.

A light bulb with double screw base 1302 is screwed into double socket 1300 in a normal fashion so the first and the fifth electrical contacts would touch, the third and the sixth electrical contacts would touch, the second and the seventh electrical contacts would touch, the fourth and the eighth electrical contacts would touch, the ninth and the eleventh electrical contacts would touch, and the tenth and the twelfth electrical contacts would touch. As a conventional light bulb with a standard Edison screw base cannot be screwed into double socket 1300, a light fixture using the double socket would qualify as a high energy efficient light fixture.

Figure 14:
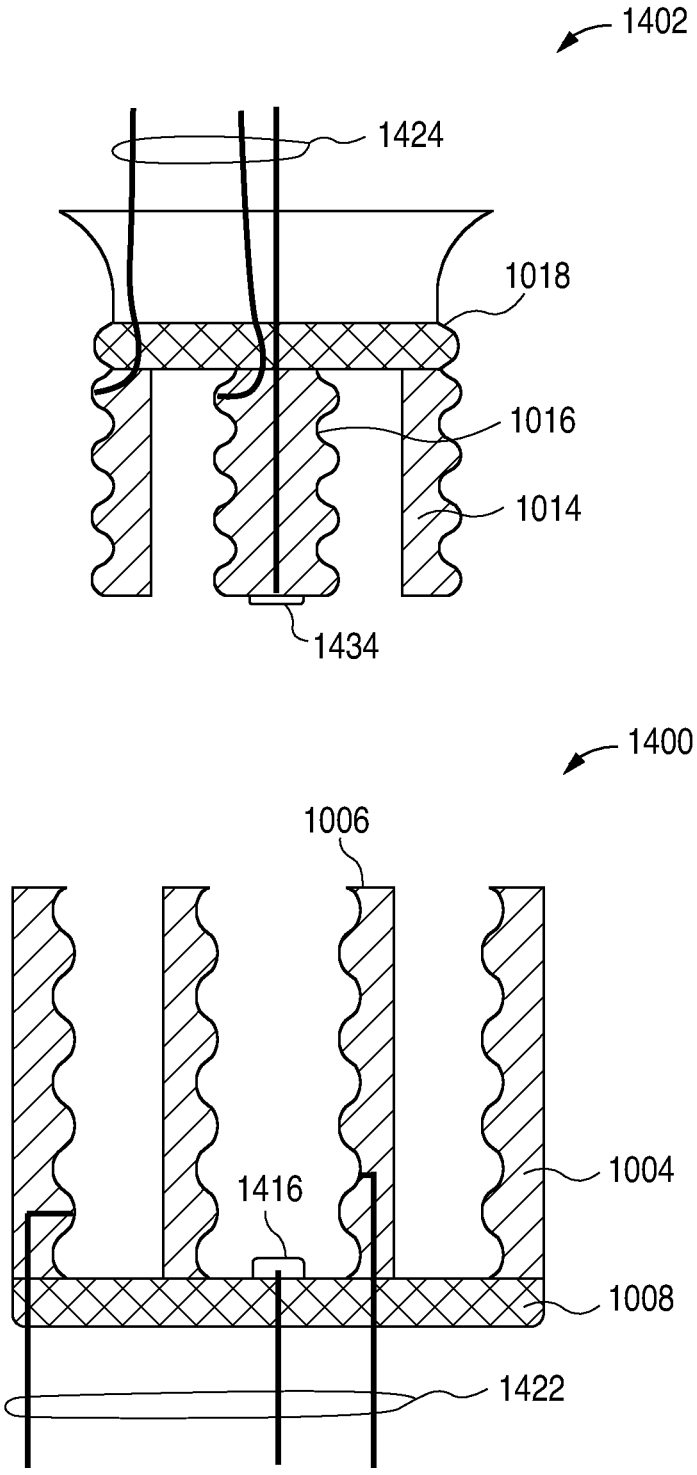
FIG. 14 shows a cross-sectional view of a lamp double socket and a compatible double screw base with their electrical contacts in a side-side-bottom configuration, all arranged in accordance with at least some embodiments of the present disclosure Use of the same reference numbers in different figures indicates similar or identical elements.

FIG. 14 shows a cross-sectional view of a lamp double socket 1400 and a compatible double screw base 1402 with their electrical contacts in a side-side-bottom configuration in one or more embodiments of the present disclosure. Double socket 1400 is similar to double socket 1000 (FIG. 10) with an additional bottom contact 1416 added within inner socket 1006 on socket base 1008. Conductive internal threads of sockets 1004, 1006 and bottom contact 1416 serve as first, second, and third electrical contacts to double screw base 1402. The three electrical contacts are connected directly or coupled indirectly to electrical lines 1422 out of double socket 1400. The three electrical contacts allows double socket 1400 to be used with three-way bulbs or with relays for three-way switching. Depending on the application, less than all the contacts may be utilized.

Double screw base 1402 is similar to double screw base 1002 (FIG. 10) with an additional bottom contact 1434 added to the bottom of inner screw base 1016. Conductive external threads of screw bases 1014, 1016, and bottom contact 1434 serve as fourth, fifth, and sixth electrical contacts to double socket 1400. Lead wires 1424 from the light source are connected directly or coupled indirectly to the three electrical contacts. Lead wires 1424 are connected to the light source according to the purpose of the application, such as providing a multi-way bulb or multi-way switching. Depending on the application, less than all the contacts may be utilized.

A light bulb with double screw base 1402 is screwed into double socket 1400 in a normal fashion so the first and the fourth electrical contacts would touch, the second and the fifth electrical contacts would touch, and the third and the sixth electrical contacts would touch. As a conventional light bulb with a standard Edison screw base cannot be screwed into double socket 1400, a light fixture using the double socket would qualify as a high energy efficient light fixture.

Various other adaptations and combinations of features of the embodiments disclosed are within the scope of the invention. Numerous embodiments are encompassed by the following claims.

The invention claimed is:

1. A lamp assembly, comprising:

a lamp socket, comprising:

a socket base;

an outer socket seated on the socket base, the outer socket being internally threaded and comprising a first electrical contact; and an inner socket seated within the outer socket on the socket base, the inner socket being internally threaded and comprising a second electrical contact, the first and the second electrical contacts being electrically insulated.

2. The lamp assembly of claim 1, wherein:

the outer socket comprises conductive first internal threads, the first internal threads being the first electrical contact; and the inner socket comprises conductive second internal threads, the second internal threads being the second electrical contact.

3. The lamp assembly of claim 2, further comprising:

a light bulb, comprising:

an outer screw base comprising an open end and conductive first external threads to match the first internal threads, the first external threads being a third electrical contact; and an inner screw base within the outer screw base, the inner screw base comprising conductive second external threads matching the second internal threads, the second external threads being a fourth electrical contact, the third and the fourth electrical contacts being electrically insulated;

wherein the first and the third electrical contacts touch and the second and the fourth electrical contacts touch when the light bulb is screwed into the lamp socket.

4. The lamp assembly of claim 1, wherein:

the outer socket comprising a nonconductive first housing and a conductive first tab, the first housing defining first internal threads, the first tab being located on the first internal threads, the first tab being the first electrical contact; and the inner socket comprising a nonconductive second housing and a conductive second tab, the second housing defining second internal threads, the second tab being located on the second internal threads, the second tab being the second electrical contact.

5. The lamp assembly of claim 1, wherein:

the outer socket comprises conductive first internal threads, the first internal threads being the first electrical contact; and the inner socket comprises second internal threads, the second internal threads comprising a conductive upper portion, a conductive lower portion, and a non-conductive middle portion electrically insulating the upper and the lower portions, the upper portion being the second electrical contact, the lower portion being a third electrical contact.

6. The lamp assembly of claim 5, further comprising:

a light bulb, comprising:

a light source;

an outer screw base comprising an open end and conductive first external threads matching the first internal threads, the first external threads being a fourth electrical contact; and an inner screw base within the outer screw base, the inner screw base comprising second external threads matching the second internal threads, the second external threads comprising a conductive other upper portion, a conductive other lower portion, and a non-conductive other middle portion electrically insulating the other upper and the other lower portions, the other upper portion being a fifth electrical conduct, the other lower portion being a sixth electrical contact;

wherein the first and the fourth electrical contacts touch, the second and the fifth electrical contacts touch, and the third and the sixth contacts touch when the light bulb is screwed into the lamp socket.

7. The lamp assembly of claim 1, wherein:

the outer socket comprises first internal threads, the first external threads comprising a conductive first upper portion, a conductive first lower portion, and a non-conductive first middle portion electrically insulating the first upper and the first lower portions, the first upper portion being the first electrical contact, the first lower portion being a third electrical contact; and the inner socket comprises second internal threads, the second internal threads comprising a conductive second upper portion, a conductive second lower portion, and a non-conductive second middle portion electrically insulating the second upper and the second lower portions, the second upper portion being the second electrical contact, the second lower portion being a fourth electrical contact.

8. The lamp assembly of claim 7, further comprising:

a light bulb, comprising:

an outer screw base comprising an open end and first external threads matching the first internal threads, the first external threads comprising a conductive third upper portion, a conductive third lower portion, and a non-conductive third middle portion electrically insulating the third upper and the third lower portions, the third upper portion being a fifth electrical contact, the third lower portion being a sixth electrical contact; and an inner screw base within the outer screw base, the inner screw base comprising second external threads, the second external threads comprising a conductive fourth upper portion, a conductive fourth lower portion, and a non-conductive fourth middle portion electrically insulating the fourth upper and the fourth lower portions, the fourth upper portion being a seventh electrical conduct, the fourth lower portion being an eighth electrical contact;

wherein the first and the fifth electrical contacts touch, the third and the sixth contacts touch, the second and the seventh electrical contacts touch, and the fourth and the eighth electrical contacts touch when the light bulb is screwed into the lamp socket.

9. The lamp assembly of claim 8, wherein:

the outer socket further comprises third external threads, the third external threads comprising a conductive fifth upper portion, a conductive fifth lower portion, and a non-conductive fifth middle portion electrically insulating the fifth upper and the fifth lower portions, the fifth upper portion being a ninth electrical contact, the fifth lower portion being a tenth electrical contact;

the light bulb further comprising a housing defining third internal threads, the third internal threads comprising a conductive sixth upper portion, a conductive sixth lower portion, and a non-conductive sixth middle portion electrically insulating the sixth upper and the sixth lower portions, the sixth upper portion being a eleventh electrical contact, the sixth lower portion being a twelfth electrical contact; and the ninth and eleventh electrical contacts touch, and the tenth and the twelfth electrical contacts touch when the light bulb is screwed into the lamp socket.

10. The lamp assembly of claim 1, wherein:

the lamp socket further comprises a third electrical contact on the socket base, the third electrical contact being located within the inner socket;

the outer socket comprises conductive first internal threads, the first internal threads being the first electrical contact; and the inner socket comprises conductive second internal threads, the second internal threads being the second electrical contact.

11. The lamp assembly of claim 10, further comprising:

a light bulb, comprising:

an outer screw base comprising an open end and conductive first external threads matching the first internal threads, the first external threads being a fourth electrical contact;

an inner screw base within the outer screw base, the inner screw base comprising conductive second external threads matching the second internal threads, the second external threads being a fifth electrical contact; and a sixth electrical contact on a distal end of the inner screw base, the fourth, the fifth, and the sixth electrical contacts being electrically insulated;

wherein the first and the fourth electrical contacts touch, the second and the fifth electrical contacts touch, and the third and the sixth electrical contacts touch when the light bulb is screwed into the lamp socket.

12. The lamp assembly of claim 1, wherein the lamp socket further comprises electrical lines coupled to the first and the second electrical contacts.

13. A light bulb, comprising:

a base;

an open-ended outer screw base seated on the base, the outer screw base being externally threaded and comprising a first electrical contact; and an inner screw base seated within the outer screw base on the base, the inner screw base being externally threaded and comprising a second electrical contact, the first and the second electrical contacts being electrically insulated.

14. The light bulb of claim 13, wherein:

the outer screw base comprising conductive first external threads, the first external threads being the first electrical contact; and the inner screw base comprising conductive second external threads, the second external threads being the second electrical contact.

15. The light bulb of claim 13, wherein:

the outer screw base comprising conductive first external threads, the first external threads being the first electrical contact; and the inner screw base comprising second external threads, the second external threads comprising a conductive upper portion, a conductive lower portion, and a non-conductive middle portion electrically insulating the upper and the lower portions, the upper portion being the second electrical conduct, the lower portion being a third electrical contact.

16. The light bulb of claim 13, wherein:

the outer screw base comprising first external threads, the first external threads comprising a conductive first upper portion, a conductive first lower portion, and a non-conductive first middle portion electrically insulating the first upper and the first lower portions, the first upper portion being the first electrical contact, the first lower portion being a third electrical contact; and the inner screw base comprising second external threads, the second external threads comprising a conductive second upper portion, a conductive second lower portion, and a non-conductive second middle portion electrically insulating the second upper and the second lower portions, the second upper portion being the second electrical conduct, the second lower portion being a fourth electrical contact.

17. The light bulb of claim 16, wherein:

the light bulb further comprising a housing defining internal threads, the internal threads comprising a conductive third upper portion, a conductive third lower portion, and a non-conductive third middle portion electrically insulating the third upper and the third lower portions, the third upper portion being a fifth electrical contact, the third lower portion being a sixth electrical contact.

18. The light bulb of claim 14, further comprising a third electrical contact on a distal end of the inner screw base, the first, the second, and the third electrical contacts being electrically insulated.

19. The light bulb of claim 13, further comprising a light source and lead wires coupling the first and the second electrical contacts to the light source.

* * * * *

UNITED STATES PATENT AND TRADEMARK OFFICE

CERTIFICATE OF CORRECTION

PATENT NO. : 8,593,050 B2
APPLICATION NO. : 13/178449
DATED : November 26, 2013
INVENTOR(S) : Kenneth S. Chin It is certified that error appears in the above-identified patent and that said Letters Patent is hereby corrected as shown below:

In the Claims

Column 11
Line 53, Claim 6, where “conduct” should read --contact--.

Column 12
Line 29, Claim 8, where “conduct” should read --contact--.

Column 12
Line 51, Claim 9, where “a” should read --an--.

Column 14
Line 23, Claim 16, where “conduct” should read --contact--.

Signed and Sealed this
Eleventh Day of February, 2014

Michelle K. Lee

Michelle K. Lee
*Deputy Director of the United States Patent and Trademark Office*